US006305930B1

(12) United States Patent
Fedak

(10) Patent No.: US 6,305,930 B1
(45) Date of Patent: Oct. 23, 2001

(54) VERTICAL MULTIPLE STAGE OVEN

(76) Inventor: Tibor Fedak, 1335 E. Steamboat Dr., Tempe, AZ (US) 85283

( * ) Notice: Subject to any disclaimer, the term of this patent is extended or adjusted under 35 U.S.C. 154(b) by 0 days.

(21) Appl. No.: 09/594,618

(22) Filed: Jun. 14, 2000

(51) Int. Cl.[7] ..... F27D 3/06

(52) U.S. Cl. ..... 432/125; 432/128; 414/153; 34/209

(58) Field of Search ..... 432/125, 128, 432/129, 132; 414/150, 153, 217; 34/190, 202, 203, 204, 205, 207, 209, 215, 236

(56) References Cited

U.S. PATENT DOCUMENTS

| | | | | |
|---|---|---|---|---|
| 185,922 | | 1/1877 | Houdaille . | |
| 270,695 | | 1/1883 | Phillips . | |
| 390,010 | | 9/1888 | Dew . | |
| 1,601,623 | | 9/1926 | Harrison . | |
| 2,325,889 | | 8/1943 | Thompson et al. . | |
| 2,620,918 | | 12/1952 | Fallon . | |
| 2,661,831 | | 12/1953 | Kenney . | |
| 2,931,524 | | 4/1960 | Hallenius . | |
| 3,343,656 | | 9/1967 | Koepke, Jr. et al. . | |
| 3,790,336 | * | 2/1974 | Brede, III et al. | 432/125 |
| 4,717,339 | * | 1/1988 | Kersting | 432/125 |
| 4,794,863 | | 1/1989 | Gates et al. . | |
| 5,203,256 | | 4/1993 | Mueller . | |
| 5,816,798 | | 10/1998 | Strohmaier . | |
| 5,941,680 | * | 8/1999 | Strohmaier | 414/156 |
| 6,164,961 | * | 12/2000 | Luscher et al. | 432/121 |

FOREIGN PATENT DOCUMENTS

| | | |
|---|---|---|
| 272 054 A1 | 9/1989 | (DE) . |
| 0192 613 | 8/1986 | (EP) . |

* cited by examiner

*Primary Examiner*—Gregory Wilson
(74) *Attorney, Agent, or Firm*—Parsons & Goltry; Robert A. Parsons; Michael W. Goltry

(57) ABSTRACT

A vertical multiple stage oven includes a first plurality of ovens in a vertical arrangement, and a second plurality of ovens in a vertical arrangement positioned adjacent the first plurality of ovens. An access port is provided to the first plurality of ovens and an exit port is provided from the second plurality of ovens. A coupling port couples the first plurality of ovens to the second plurality of ovens. A continuous pathway is defined through the first plurality of ovens and through the second plurality of ovens from the access port, through the coupling port to the exit port. Each oven is sealed from adjacent ovens by trays moving along the pathway.

47 Claims, 10 Drawing Sheets

VERTICAL MULTIPLE STAGE OVEN

FIELD OF THE INVENTION

This invention relates to apparatus and method for heating components e.g., electronic components and the like.

More particularly, the present invention relates to apparatus and method for heating components in a series of steps.

BACKGROUND OF THE INVENTION

In many instances, steps or methods of heating components or devices, such as the heating of electronic components during various fabrication processes, are included in assembly lines and the like. The heating process may include a relatively high heat for an extended period of time, a plurality of steps requiring different temperatures, etc. In the past, ovens for heating processes were generally horizontal and required large or extended areas of an assembly line. Also, because of the large horizontal area, it was difficult and expensive to maintain a desired temperature in these ovens.

To reduce the amount of area required by heating ovens in assembly lines and the like, some vertical ovens have been developed. A major problem with vertical ovens is that the heat generated within the oven tends to rise so that the upper portions of the oven are substantially hotter than the lower portions of the oven. Thus, it can be seen that temperatures within vertical ovens are very difficult to control.

A second problem with vertical ovens is the movement of components or devices through the oven. Conveyor belts and the like must be vertical to provide the vertical movement and include many moving parts which can generate particulates. Any dirt or particles worn from the conveyor system will generally fall directly into the components or devices being heated or contaminate the whole system. To overcome this problem, some vertical ovens have been devised with a system that steps the components or devices through the oven. However, these systems have a problem in that they generally must be included within the oven and are, therefore, heated as the oven is heated. As the systems are heated and cooled they expand and this expansion can dramatically change the length of steps that the components or devices are moved and can have a deleterious effect on the operation of the oven. Furthermore, these stepped systems still incorporate moving parts which are in contact and which can generate particulates within the oven. While superior to previous systems, it is desirable to eliminate anything which generates particulates.

Accordingly it is highly desirable to provide apparatus and a method of overcoming these problems and disadvantages.

It is an object of the present invention to provide a new and improved vertical multiple stage oven.

It is another object of the present invention to provide a new and improved vertical multiple stage oven with multiple heating stages which can be accurately controlled.

It is still another object of the present invention to provide a new and improved vertical multiple stage oven with a transport system that is clean and can be easily compensated for changing lengths.

It is yet another object of the present invention to provide a new and improved vertical multiple stage oven incorporating a plurality of heating stages within a single housing.

SUMMARY OF THE INVENTION

Briefly, to achieve the desired objects of the instant invention in accordance with a preferred embodiment thereof, provided is a vertical multiple stage oven including a first plurality of ovens in a vertical arrangement, and a second plurality of ovens in a vertical arrangement positioned adjacent the first plurality of ovens. An access port is provided to the first plurality of ovens and an exit port is provided from the second plurality of ovens. A coupling port couples the first plurality of ovens to the second plurality of ovens. A continuous pathway is defined through the first plurality of ovens and through the second plurality of ovens from the access port, through the coupling port to the exit port. Each oven is sealed from adjacent ovens by trays moving along the pathway.

Also provided is a method of heating components in a plurality of stages including providing a vertical multiple stage oven including a first plurality of ovens in a vertical arrangement, a second plurality of ovens in a vertical arrangement positioned adjacent the first plurality of ovens, and a continuous pathway defined from an access port through the first plurality of ovens, through a coupling port to the second plurality of ovens, and through an exit port from the second plurality of ovens, each of the first plurality of ovens and the second plurality of ovens includes a tray input opening and a tray output opening delineating the pathway with each of the tray input openings and tray output openings having an approximately similar area. Positioning the components on trays, each tray having an area approximately similar to the area of the tray input openings and tray output openings. Each of the trays is then moved in steps along the continuous pathway from the access port to the exit port, at least one of the steps It positioning one of the plurality of trays in one of the tray input openings and tray output openings so as to seal corresponding vertically adjacent ovens in one of the first plurality of ovens and the second plurality of ovens from each other.

BRIEF DESCRIPTION OF THE DRAWINGS

The specific objects and advantages of the present instant invention will become readily apparent to those skilled in the art from the following detailed description thereof taken in conjunction with the drawings in which.

DESCRIPTION OF THE PREFERRED EMBODIMENT

Figure 1:
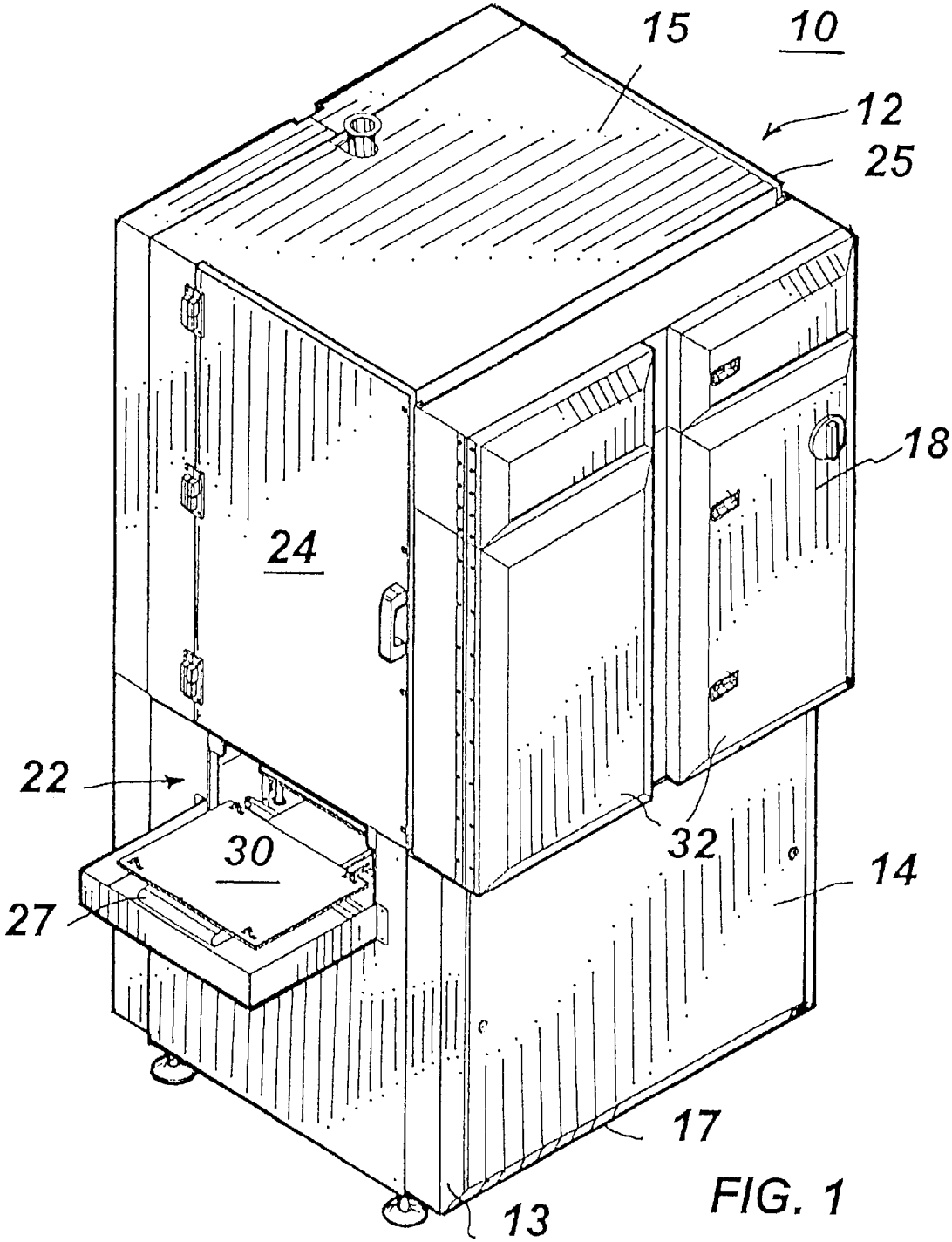
FIG. 1 is a perspective view of a vertical multiple stage oven in accordance with the present invention.
Figure 2:
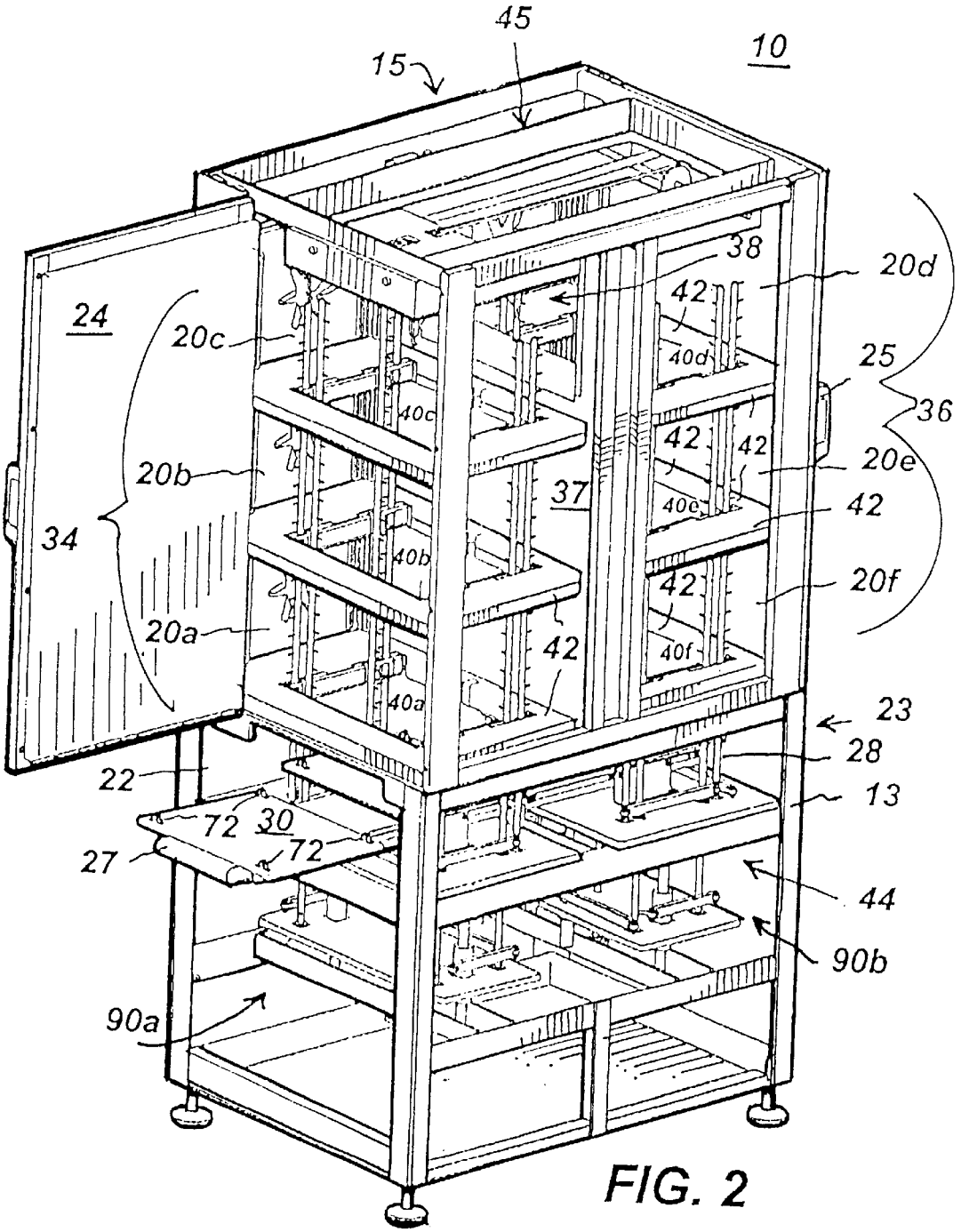
FIG. 2 is a perspective view of the vertical multiple stage oven of FIG. 1 with the housing sides removed to show the inner construction.

Turning now to the drawings, in which like reference characters indicate corresponding elements throughout the several views, attention is first directed to FIGS. 1 and 2 which illustrates a vertical multiple stage oven, generally designated 10. Oven 10 includes a housing 12 consisting of a framework 13 covered by panels 14. The housing has a top end 15, a bottom end 17, and is divided into an electrical and control compartment 18, and ovens 20*a–f* (FIG. 2). An access port 22 and an exit port 23 are provided in housing 12 to allow the introduction of components into and removal of components from ovens 20*a–f*. Typically, continuous insertion and extraction of components occurs while oven 10 is in operation. Additional access to ovens 20*a–f*, when not in use, is provided by doors 24 and 25. Thus, the interior of ovens 20*a–f* can be accessed as required for maintenance, cleaning, etc.

An insertion system 27 and extraction system 28 are employed to introduce components into and extract components from oven 10 through access port 22 and exit port 23 respectively. Insertion system 22 and extraction system 23 can be a variety of different devices including conveyors, beams, manual insertion, etc. During operation of oven 10, components can be continuously fed into ovens 20*a–f* and stepped through a curing process, as will be detailed presently. The curing process can include heating of components or cooling of components as required. Each oven is capable of heating or cooling a component, which actions can be accomplished in adjacent ovens. The components are positioned on a carrier for processing in oven 10. The carrier can be substantially any structure for supporting components, but in this instance is a tray 30 having a solid base. The purpose of the solid base will become clear as the description progresses.

Electric and control compartment 18 includes the necessary connections, switches, breakers, power couplings, etc. for supplying power to the various elements of oven 10, as well as it the logic systems for proper control and adjustment of oven 10. 18 Compartment 18 is accessed though panels or doors 32. It will be understood that while the electrical and control elements are carried by oven 10 within compartment 18, various of these elements, such as control or logic systems, etc. can be located separately or remotely from oven 10 if desired.

Referring specifically to FIG. 2, oven 10 is illustrated with panels 14 removed and door 24 open. In the preferred embodiment, ovens 20*a–f* are vertically arranged in two adjacent columns or stacks of three ovens. While two stack of three ovens are illustrated, it will be understood that more or less ovens can be present in a stack, and more or less stacks can be employed. A stack 34 including ovens 20*a–c* and a stack 36 including ovens 20*d–f* are separated by a common wall 37. It will be understood that all of the walls, door or panels described herein can be insulated to prevent heat loss and to help maintain temperatures and reduce temperature fluctuations within each separate oven. Access port 22 is located at the bottom of stack 34 and exit port 23 is located at the bottom of stack 36. A coupling port 38 couples stack 34 to stack 36, and is located proximate top end 15 through common wall 37. While coupling port 38 is illustrated as being formed between oven 20*c* and oven 20*d*, it will be understood that coupling port 38 can be formed above stacks 34 and 36. A continuous pathway is formed through stack 34 and through stack 36 from access port 22, through coupling port 38 to exit port 23. Each of ovens 20*a–f* includes a tray input opening and a tray output opening delineating the continuous pathway. Oven 20*a* has a tray opening 40*a*, and a tray opening 40*b*. Tray opening 40*a* function as a tray input opening for oven 20*a* and tray opening 40*b* functions as a tray output opening for oven 20*a*. Tray opening 40*b* functions as a tray input opening for oven 20*b* and a tray opening 40*c* functions as a tray output opening for oven 20*b*. Tray opening 40*c* function as a tray input opening for oven 20*c* and coupling port 38 functions as a tray output opening for oven 20*c*. Coupling port 38 functions as a tray input opening for oven 20*d* and a tray opening 40*d* functions as a tray output opening for oven 20*d*. Tray opening 40*d* functions as a tray input opening for oven 20*e* and a tray opening 40*e* functions as a tray output opening for oven 20*e*. Tray opening 40*e* function as a tray input opening for oven 20*f* and a tray opening 40*f* functions as a tray output opening for oven 20*f*. Horizontal walls 42 are positioned between vertically adjacent ovens 20*a–f*. Horizontal walls 42 define tray input openings and tray output openings of adjacent ovens in this embodiment.

A vertical transport system 44 is mounted within oven 10 to receive and move trays 30 in steps along the continuous pathway from access port 22 to exit port 23. The steps along the continuous pathway include steps within each oven 20*a–f* and steps which place a tray within tray openings 40*a–f*. A lateral transport system 45 carries trays 30 along the continuous pathway through coupling port 38 from stack 34 to stack 36. Each tray 30 is approximately the same size as tray openings 40*a–f*. When positioned within tray openings 40*a–f*, the trays seal the ovens reducing thermal transfer between adjacent ovens. In this manner, each oven can be maintained at different temperatures, and fluctuations in the temperature are extremely low.

Figure 3:
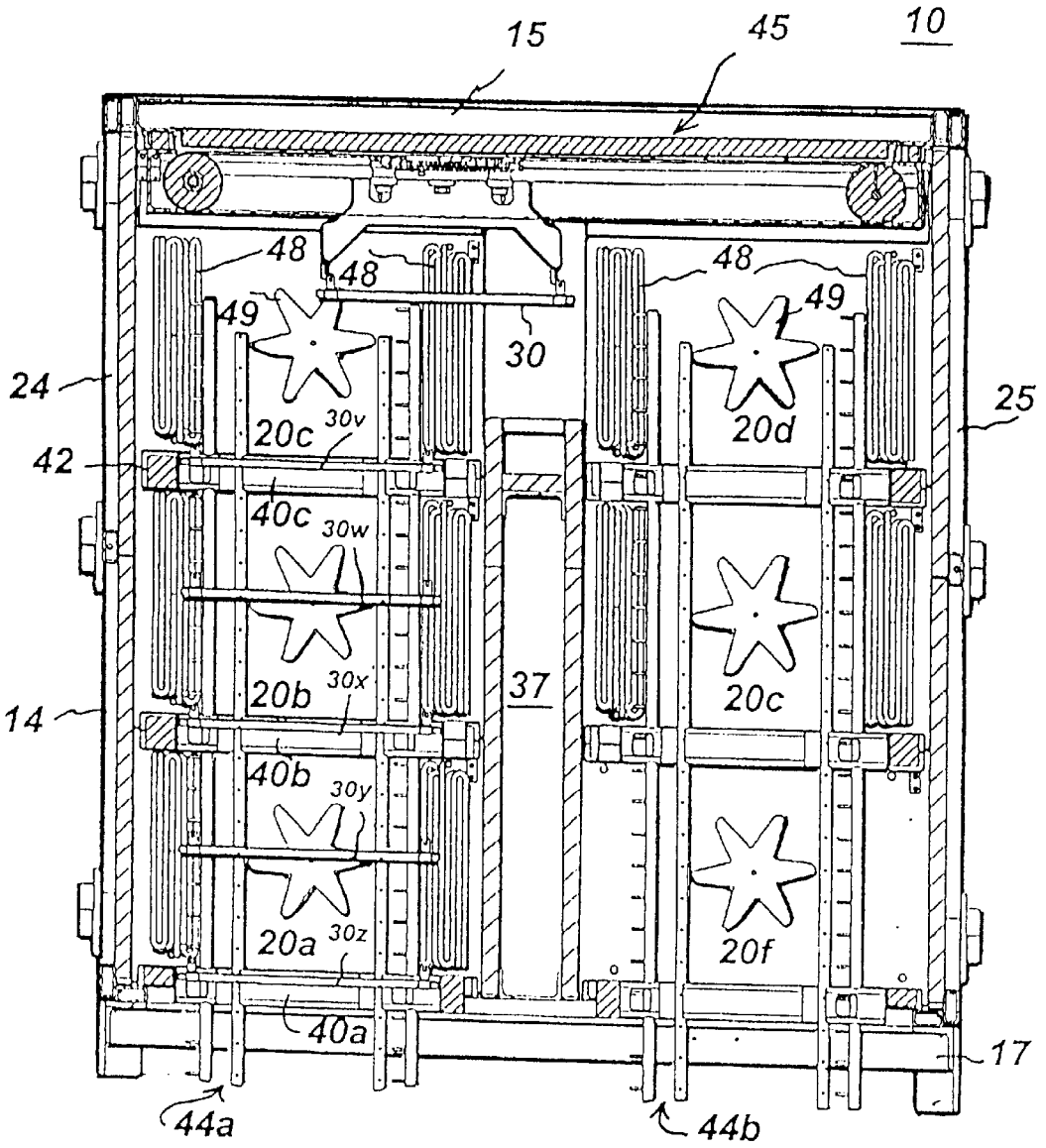
FIG. 3 is an enlarged sectional view as seen from the line 3—3 of FIG. 2.
Figure 4:
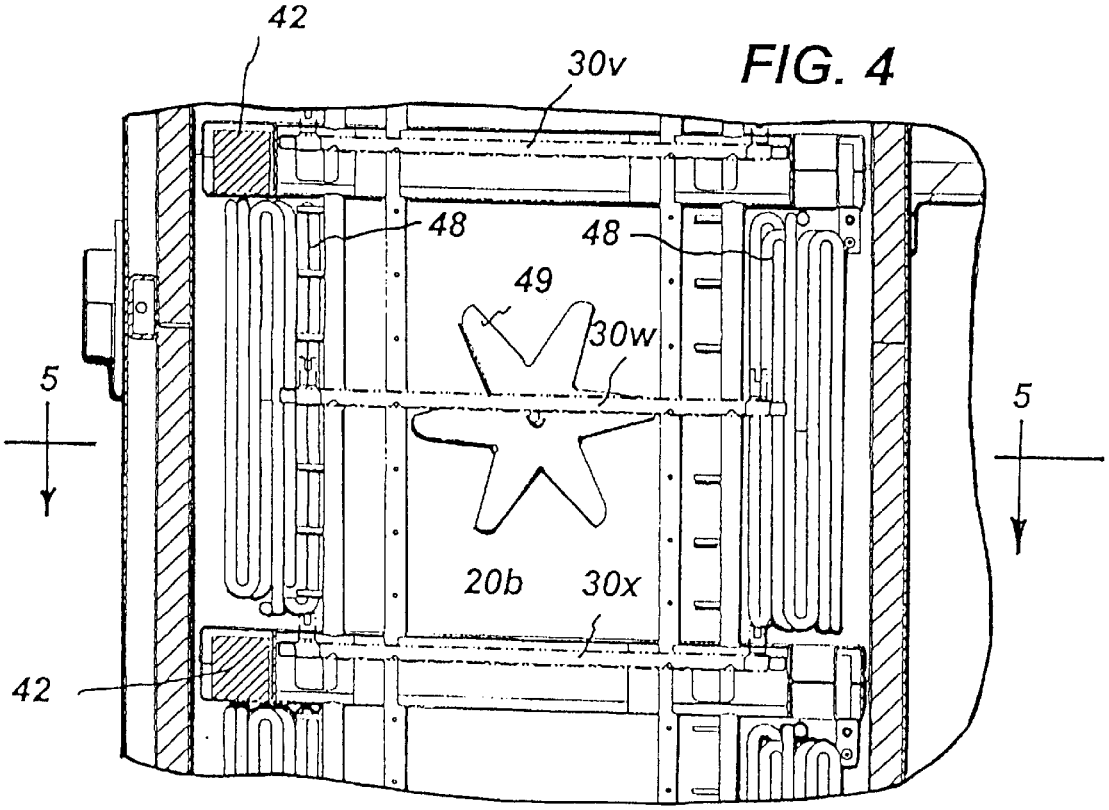
FIG. 4 is an enlarged view of a portion of FIG. 3.
Figure 5:
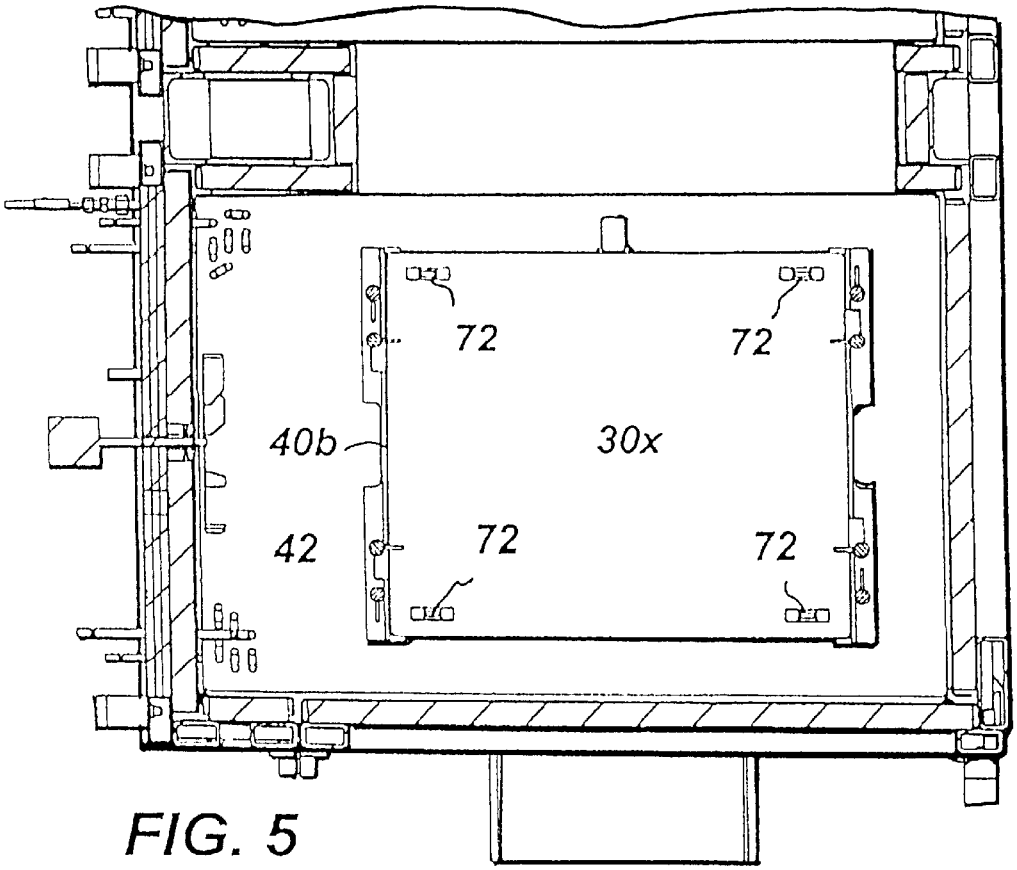
FIG. 5 is an enlarged sectional view as seen from the line 5—5 in FIG. 4.

Turning now to FIG. 3, each of ovens 20*a–f* includes heating elements 48 and fan 49 for achieving and maintaining a desired temperature. During operation of oven 10, temperature fluctuation and thermal transfer between ovens 20*a–f* is reduced by the placement of trays stepped through the continuous pathway. For purposes of explanation, five trays, designated 30*v–*30*z* are illustrated in various sequential steps along the continuous pathway. Tray 30*v*, which was the first tray inserted into oven 10 has progressed in sequential steps to be positioned in tray opening 40*c*. Here it should be noted that tray 30*v* is positioned to be substantially flush with a top surface of horizontal wall 42 defining tray opening 40*c*. In this position, ovens 20*c* and 20*b* are thermally separated, and any components (none shown) carried by tray 30*v* are completely within oven 20*c*. A better view of the sealing function can be seen with reference to FIG. 5. A more detailed explanation will be forthcoming. Tray 30*w*, inserted after tray 30*v* has progressed to a central position within oven 20*b*. Tray 30*x*, inserted subsequent to tray 30*w* has progressed to a sealing position within tray opening 40*b* between oven 20*b* and oven 20*a*. Tray 30*y*, inserted after tray 30*x* has progressed to a central position within oven 20*a*. Tray 30*z*, inserted subsequent to tray 30*y* has progressed to a sealing position within tray opening 40*a* between oven 20*a* and access port 22. It should be understood by the foregoing description that each tray 30 inserted into oven 10 will progress through each of the steps described in stack 34, and will continue along the continuous pathway in reverse steps through stack 36. FIG. 4 is an enlarged view in more detail of oven 20*b*. Referring briefly to FIG. 5 the positioning of tray 30*x* in opening 40*b* of oven 20*b* is illustrated in more detail and is exemplary of each of ovens 20*a–f*. It should be specifically noted that tray 30*x* is sized to closely match opening 40*b*. The size of tray 30*x* (i.e., shape and area) is such that the edges of tray 30*x* are slidably positioned adjacent the edges of tray opening 40*b* so as to permit free movement while producing a minimum gap to minimize thermal transfer.

Figure 6:
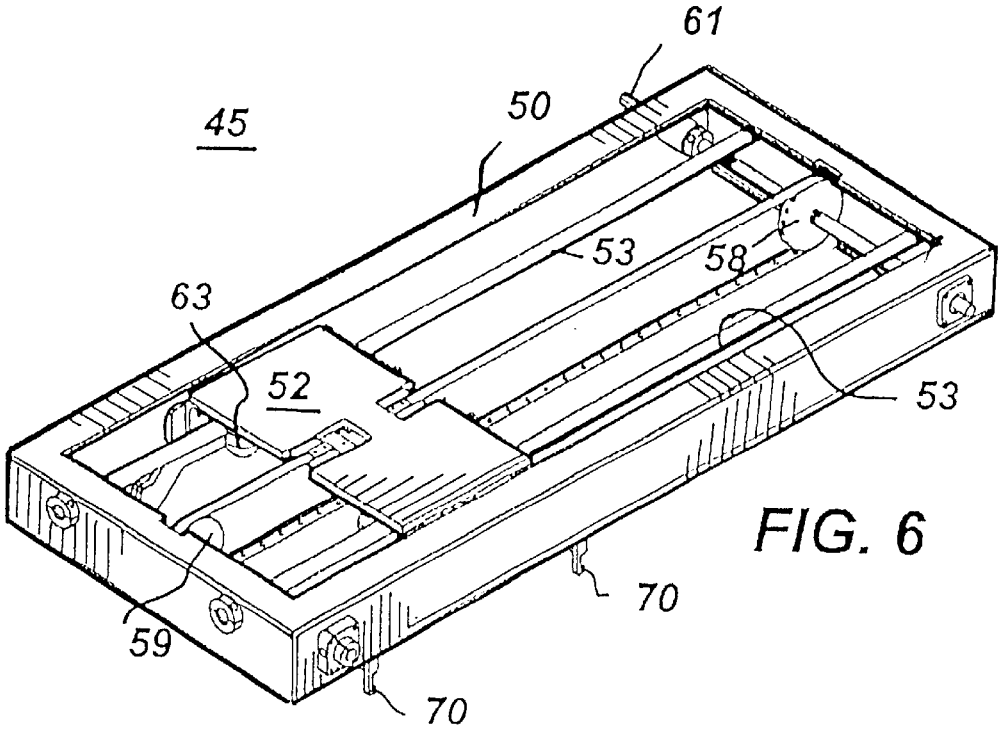
FIG. 6 is a perspective view of a lateral transport system of FIG. 2.
Figure 7:
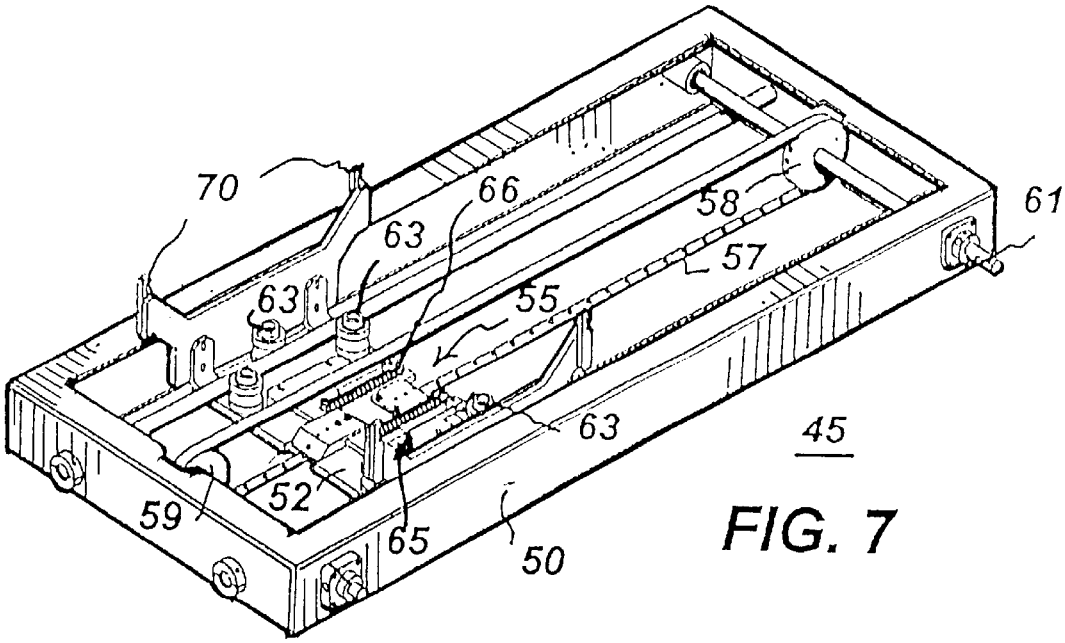
FIG. 7 is an inverted perspective view of the lateral transport system of FIG. 6.

Referring now to FIGS. 6 and 7 lateral transfer system 45 includes a frame 50 coupled to framework 13 proximate top end 15. Frame 50 is generally rectangular and overlies stack 34 and stack 36. A carriage 52 is reciprocally movable within frame 50 and is supported and guided by a pair of rails 53 extending between ends of frame 50. Carriage 52 is moved by a drive assembly 55 including a continuous belt 57 driven by a pulley 58 at one end and guided by a pulley 59 at the opposing end of frame 50. Pulley 58 is mounted on an axle 61 which is driven by a reversible motor (not shown). It will be understood that various other methods of moving carriage 52 are possible, and that present method is illustrated for its simplicity.

Carriage 52 is mounted on rails 53 by means of a plurality of rollers 63 which engage rails 53. Belt tightening apparatus 65 includes a pair of springs 66 which are mounted to provide a continuous tightening bias on belt 57. Thus in the event belt 57 expands or contracts during use or due to temperature, belt tightening apparatus 65 and springs 66 adjust for the expansion or contraction to ensure that the amount of lateral movement remains constant.

Lateral transport system 45 receives trays 30 from a last step in stack 34 and carries trays 30 to a first step in stack 36. Lateral transport system 45 engages trays 30 with a plurality of vertically extending hooks 70 designed to engage a plurality of projections 72 extending upwardly from each tray 30. Projections 72 are loops, eyes, brackets, hooks or the like, capable of temporarily engaging hooks 70. In this preferred embodiment, four hooks 70 are provided, one extending from each corner of carriage 52. Four corresponding projections 72 extend from the corners of each tray 30. Hooks 70 are positioned to engage projections 72 on each tray 30 during an upward and downward reciprocation of a portion of vertical transport system 44 associated with stack 34 and disengage projections 72 during an upward and downward reciprocation of a portion of vertical transport system 44 associated with stack 36.

Figure 8:
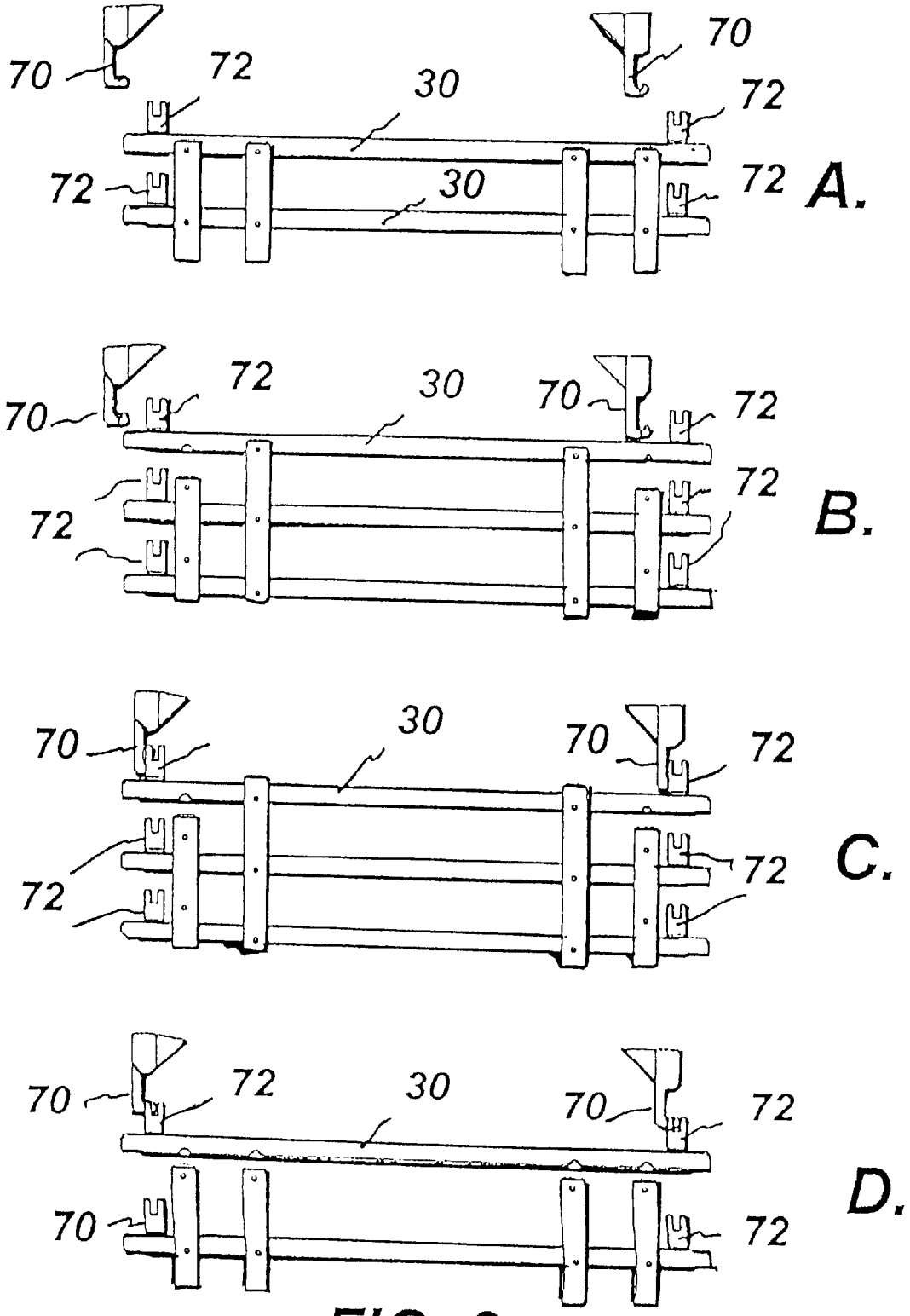
FIGS. 8A through 8D illustrate sequential steps in the engagement of the lateral transport system of FIG. 6.

Turning now to FIGS. 8A–D, the engagement of tray 30 by hooks 70 is illustrated schematically in a series of sequential steps. FIG.8A illustrates hooks 70 are positioned in a standby position, with tray 30 in the last processing step of oven 20*c* of stack 34. FIG. 8B illustrates tray 30 being raised by vertical transport system 44. FIG. 8C illustrates lateral transport system 45 moving carriage 52 slightly laterally to positioning each of the four hooks 70 within corresponding ones of projections 72. FIG. 8D illustrates vertical transport system 44 in a lowered position so that hooks 70 contact and engage projections 72, lifting tray 30 from vertical transport system 44. Lateral transport system 45 is then activated to move tray 30 horizontally through coupling port 38 (see FIG. 3) into an overlying position above stack 36. At this point the portion of vertical transport system 44 associated with stack 36 reverses the series of steps illustrated in FIGS. 8A–D to disengage projections 72 from hooks 70.

Figure 9:
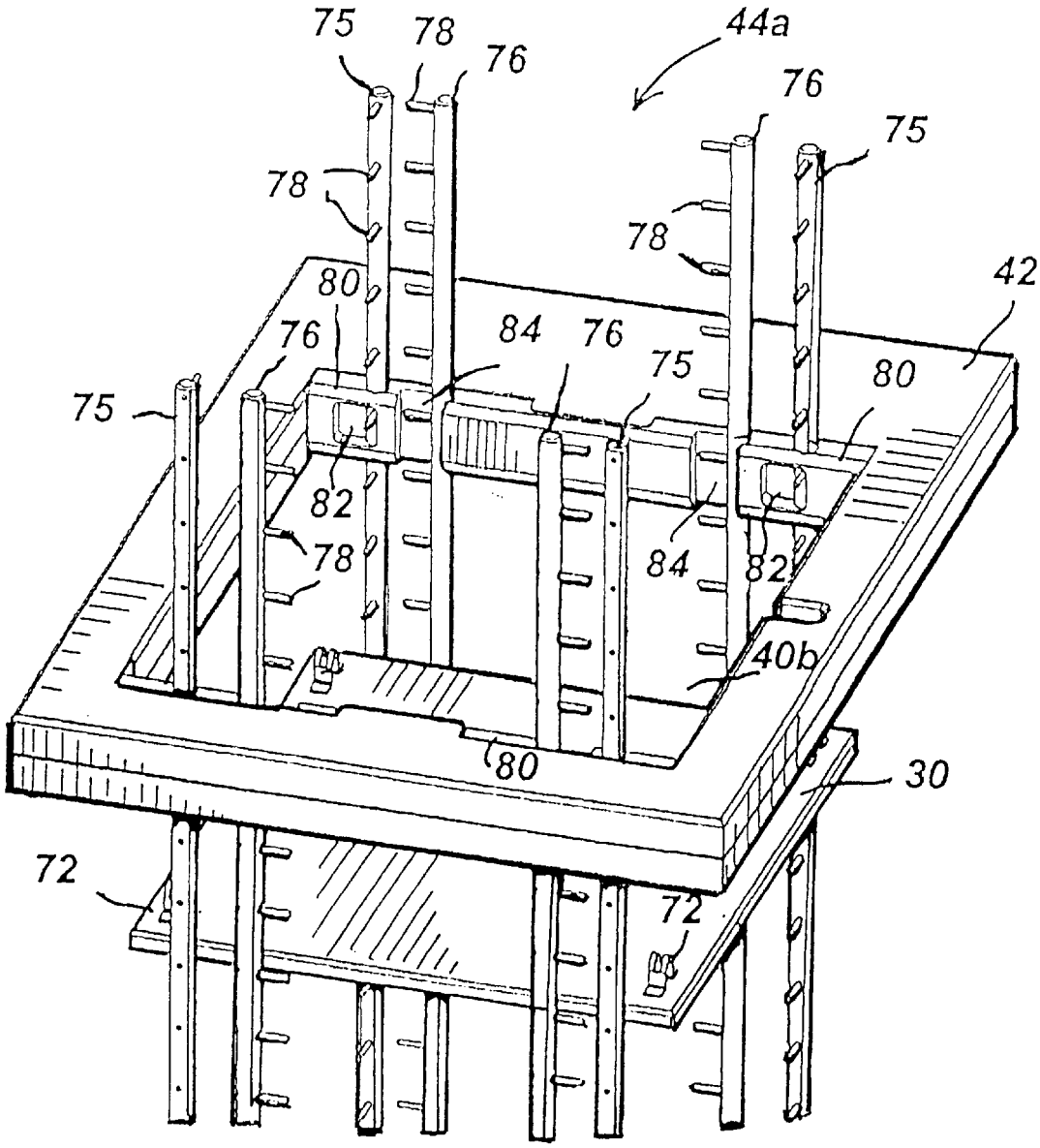
FIG. 9 is an enlarged perspective view of a portion of FIG. 2.

Vertical transport system 44 includes a portion 44*a* and 44*b* corresponding to stack 34 and stack 36, respectively, as can be seen with reference to FIGS. 2 and 3. Turning to FIG. 9 a partial view of portion 44*a* is illustrated. It will be understood that portion 44*b* will be substantially identical but operating in a reverse procedure, and therefore, will not be described herein. Portion 44*a* includes a plurality of elongated support elements 75 each mounted for rotation about its longitudinal axis, and a plurality of elongated transport elements 76 each mounted for rotation about its longitudinal axis and for reciprocation along its longitudinal axis. In this preferred embodiment, support elements 75 and transport elements 76 each include four elongated rods, although it will be understood that other shapes elements may be employed. Each support element 75 and each transport element 76 has a plurality of tray engagement members attached thereto. The plurality of engagement members include pins 78 radially extending from each support element 75 and each transport element 76 in evenly spaced intervals. As can be seen with reference back to FIG. 2, support elements 75 and transport elements 76 extend from adjacent lateral transport system 45 in oven 20*c* through opening 40*a* of oven 20*a* out of stack 34. Support elements 75 and transport elements 76 are positioned along a portion of the continuous pathway within openings 40*a*, 40*b* and 40*c*.

Referring specifically to FIG. 9, each support element 75 is positioned proximate a corner of opening 40*b* and sealed by a bearing 80 constructed to permit axial rotation. Because pins 78 extend axially from each support element 75, an opening 82 is provided within bearing 80 to allow pins 78 of each support element 75 to pivot ninety degrees for purposes which will be discussed presently. Each transport element 76 is positioned proximate a corner of opening 40*b* adjacent each support element 75, and sealed by bearing 80 constructed to permit axial rotation and axial translation. Because pins 78 extend axially from each transport element 76, a slot 84 is provided within bearing 80 to allow pins 78 of each transport element 76 to pivot ninety degrees and translate in reciprocating directions, for purposes which will be discussed presently. In this embodiment a pair of bearings 80 are each illustrated as a continuous piece along opposed sides of opening 40*b* with holes 82 and slots 84 formed at each end of each continuous piece. By utilizing bearings 80 extending entirely along the opposing sides of opening 40*b*, a continuous edge is produced which is easily sealed by tray 30. It should also be noted that when tray 30 is positioned within opening 40*b* (see FIG. 5) it substantially closes openings 82. In this position, tray 30 and pins 78 of transport element 76 substantially close slots 84. It should further be noted that while horizontal wall 42 having opening 40*b* is illustrated and described, each horizontal wall 42 containing openings 40*a–f* carries bearings 80.

Referring back to FIG. 2, portions 44*a* and 44*b* of vertical transport system 44 each includes a motor assembly 90*a* and 90*b* corresponding to stack 34 and stack 36, respectively. Since both motor assemblies are similar, only one will be described in detail, but it will be understood that the motor assemblies of both portions operate in a similar manner. With additional reference to FIGS. 10A–D ends of support elements 75 and transport elements 76 extending from stack 34, are coupled to motor assembly 90*a*. Motor assembly 90*a* includes a motor 92 for rotating support elements 75, a motor 93 for rotating transport elements 76, and a motor 94 for reciprocating transport elements 76. With additional reference to FIG. 11, support elements 75 are rotated ninety degrees concurrently by a linkage assembly 95. The ends of support elements 75 and motor 92 are coupled to and supported by a plate 96 rigidly held in position below stack 34 and attached to frame 13. Transport elements 76 extend through plate 96 (by means of holes or openings not shown) and ends thereof are coupled to a plate 98. Transport elements 76 are rotated ninety degrees concurrently by a linkage assembly 99. Linkage assembly 99 is substantially similar to linkage assembly 95 and therefore will not be described in further detail. Motor 93 is also coupled to and supported by plate 98. Plate 98 is moved in a reciprocating vertical motion by motor 94 actuating a worm drive 100. Worm drive 100 is adjustable to compensate for axial expansion of support elements 75 and transport elements 76. The adjustment can be to the length of the step and also to the starting or stopping point of each step. A computer and sensors can be employed to determine the amount of compensation required and to control motor 94.

Figure 10:
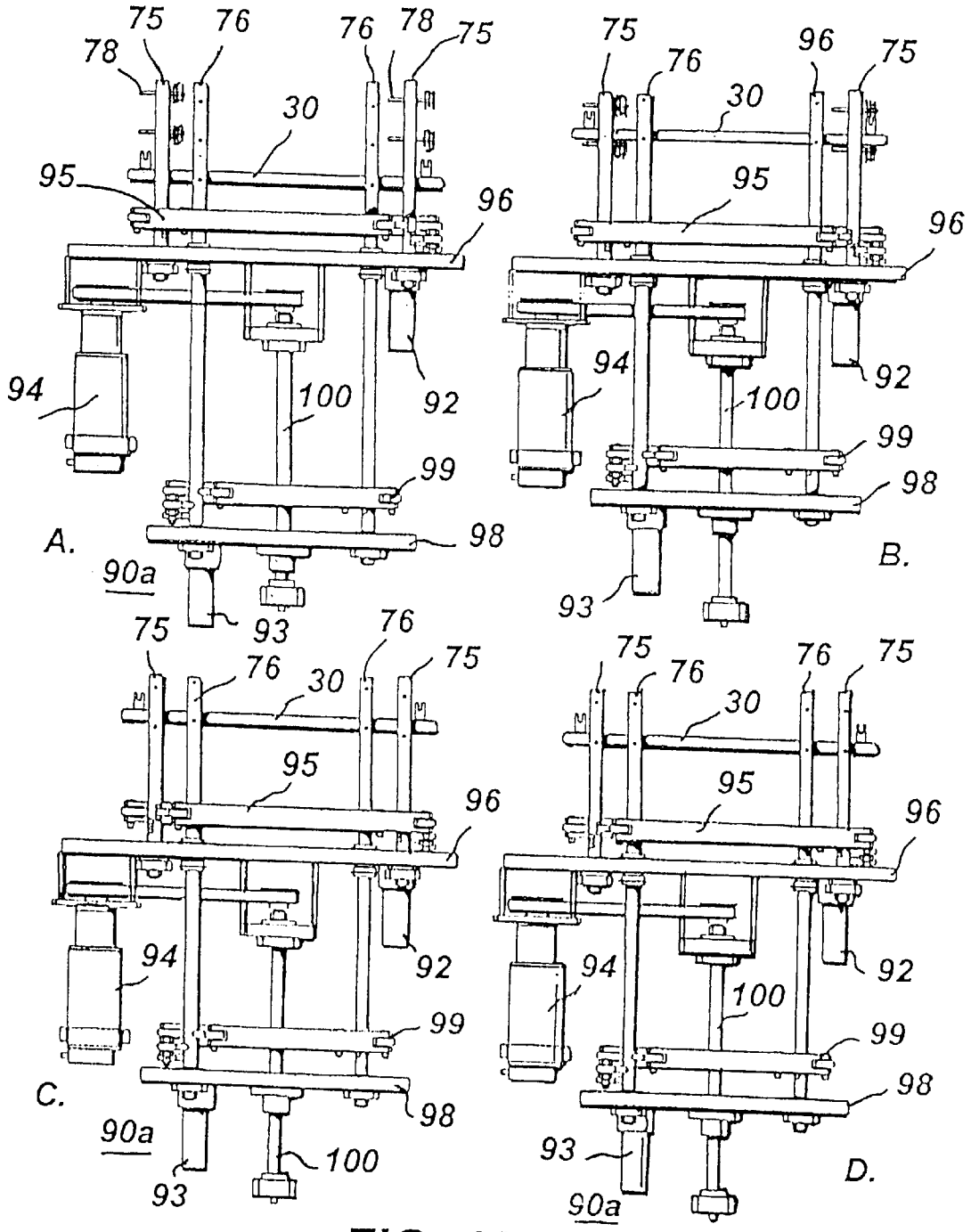
FIG. 10A through FIG. 10D illustrate sequential motions in a step of the vertical transport system.
Figure 11:
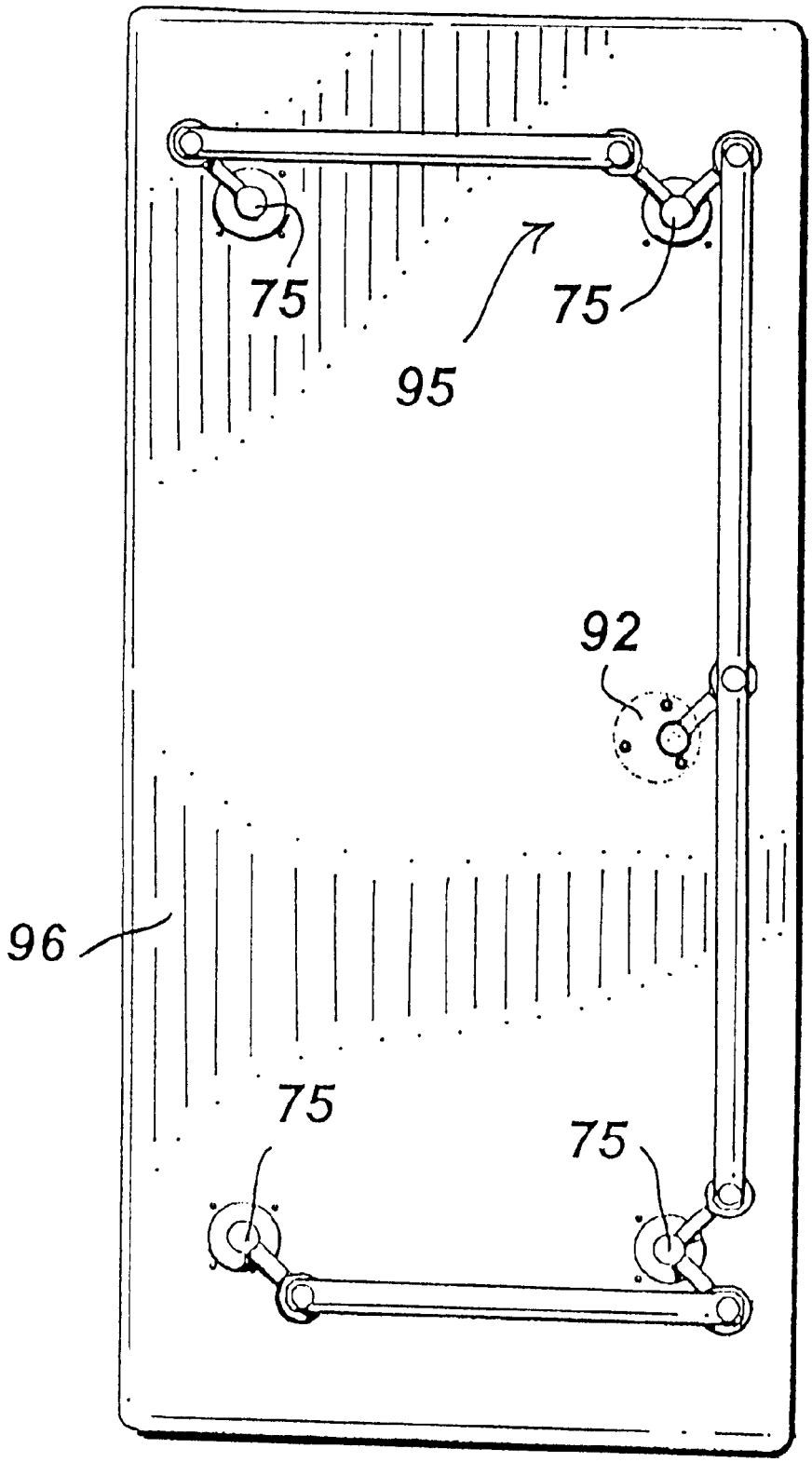
FIG. 11 is a top plan view of FIG. 10A.

Still to FIGS. 10A–D, a series of sequential motions in a step are illustrated. In this specific example the figures illustrate tray 30 having been inserted through access port 22 by insertion system 27 preparatory to stepping through a curing or heating process. Referring specifically to FIG. 10A support elements 75 have been rotated ninety degrees, removing pins 78 from the continuous pathway. Tray 30 is supported by pins 78 of transport elements 76. In FIG. 10B, motor 94 has been activated to turn worm drive 100 sufficiently to raise plate 98, and therefore transport elements 76, slightly more than one step, so that tray 30 is positioned above the height of pins 78 of support elements 75. It should be noted that a step is preferably the distance between pins 78. This distance can be adjusted by removing or moving pins, and adjusting motor 94 and worm drive 100 accordingly. In FIG. 10C, support elements 75 are rotated ninety degrees by motor 92, to position pins 78 in the continuous pathway below tray 30. In FIG. 10D, transport element 76 is lowered slightly to the full step position, wherein pins 78 of support elements 75 support tray 30. At this point, transport elements 76 are rotated ninety degrees, removing pins 78 of transport elements 76 from the continuous pathway permitting transport elements 76 to be returned to their starting position, preparatory to beginning a subsequent step.

Referring back to FIGS. 2 and 10A–D, it can be seen that each support element 75 and transport element 76 is fixed to plate 96 and plate 98, respectively at their lower ends, while their upper ends remain free (see FIG. 3). This permits axial expansion of support elements 75 and transport elements 76 without binding or distortion of their shape. The position of support elements 75 and transport elements 76 is maintained and guided by bearings 80 carried by each of horizontal walls 42. Additionally, bearings 80 seal support elements 75 and transport elements 76 within openings 40*a–f* permitting trays 30 to complete the closure and sealing of each of the plurality of ovens 20*a–f*. Since ovens can be individually sealed, each can be maintained at a different temperature without substantially affecting adjacent ovens. In this manner, greater accuracy in the curing process can be achieved, and less time is required to stabilize temperatures. It should be specifically noted that all of the moving parts for the vertical transport system 44 (i.e. all parts included in motor assembly 90*a*), all located outside the continuous pathway, and specifically, outside ovens 20*a–f*. Moving parts specifically refers to parts which are in wearing engagement such as the linkages 95 and 99. This reduces or eliminates particulates produced by frictional engagement of parts within the ovens.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

What is claimed is:

1. A vertical multiple stage oven comprising:

a first plurality of ovens in a vertical arrangement;

a second plurality of ovens in a vertical arrangement positioned adjacent the first plurality of ovens;

an access port to the first plurality of ovens;

an exit port from the second plurality of ovens;

a coupling port coupling the first plurality of ovens to the second plurality of ovens;

a continuous pathway through the first plurality of ovens and through the second plurality of ovens from the access port, through the coupling port to the exit port;

a vertical transport system adapted to receive a plurality of trays and move each tray of the plurality of trays in steps along the continuous pathway from the access port to the exit port, the steps along the continuous pathway include steps within each oven and steps in tray input openings and tray output openings of each oven; and each tray of the plurality of trays the vertical transport system is adapted to receive is approximately the same size as the tray input openings and tray output openings, and trays positioned within the tray input openings and tray output openings seal a corresponding one of the first and second plurality of ovens from an adjacent one of the first and second plurality of ovens.

2. A vertical multiple stage oven as claimed in claim 1 wherein the first plurality of ovens and the second plurality of ovens are included within a common housing, with the access port and the exit port defined by the common housing, and each of the first plurality of ovens and the second plurality of ovens includes a tray input opening and a tray output opening delineating the pathway.

3. A vertical multiple stage oven comprising:

a first plurality of ovens in a vertical arrangement;

a second plurality of ovens in a vertical arrangement positioned adjacent the first plurality of ovens;

an access port to the first plurality of ovens;

an exit port from the second plurality of ovens;

a coupling port coupling the first plurality of ovens to the second plurality of ovens;

a continuous pathway through the first plurality of ovens and through the second plurality of ovens from the access port, through the coupling port to the exit port; and a vertical transport system adapted to receive a plurality of trays and move each tray of the plurality of trays in steps along the continuous pathway from the access port to the exit port, the vertical transport system includes a plurality of elongated support elements each mounted for rotation about a longitudinal axis, and a plurality of elongated transport elements each mounted for rotation about a longitudinal axis and for reciprocation along the longitudinal axis, each support element and transport element having a plurality of tray engaging members attached thereto.

4. A vertical multiple stage oven as claimed in claim 3 wherein the plurality of support elements and transport elements include vertically extending rods, and the plurality of engagement members include pins radially extending from the rods.

5. A vertical multiple stage oven as claimed in claim 3 wherein the plurality of support elements and the plurality of transport elements are actuated by a motor assembly coupled to one end.

6. A vertical multiple stage oven as claimed in claim 5 further including horizontal walls between vertically adjacent ovens of the plurality of ovens, the horizontal walls defining the tray input opening and tray output opening of adjacent ovens.

7. A vertical multiple stage oven as claimed in claim 6 wherein the horizontal walls each include bearings which receive and seal the plurality of support elements and transport elements within the tray input openings and tray output openings, an end of each of the plurality of support elements and transport elements opposite the one end coupled to the motor assembly being free and the bearings stabilizing and permitting axial expansion of the plurality of support elements and transport elements.

8. A vertical multiple stage oven as claimed in claim 7 wherein the motor assembly includes apparatus for reciprocation of the plurality of transport elements, which is adjustable to compensate for the axial expansion of the plurality of support elements and transport elements.

9. A vertical multiple stage oven as claimed in claim 6 further including a lateral transport system carrying trays along the continuous pathway through the coupling port from the first plurality of ovens to the second plurality of ovens.

10. A vertical multiple stage oven as claimed in claim 9 wherein the lateral transport system receives trays from a last step in the first plurality of ovens and carries the trays to a first step in the second plurality of ovens.

11. A vertical multiple stage oven as claimed in claim 10 wherein the elongated transport elements are constructed to lift trays during reciprocation in the last step in the first plurality of ovens into engagement with the lateral transport system and to lift trays during reciprocation in the first step in the second plurality of ovens out of engagement with the lateral transport system.

12. A vertical multiple stage oven as claimed in claim 11 wherein the lateral transport system includes a plurality of vertically extending hooks designed to engage a plurality of projections on each tray, with the hooks being positioned to engage the projections on a tray during an upward reciprocation of the vertical transport system and disengage the tray from the tray engaging members on the elongated transport elements during a downward reciprocation of the vertical transport system.

13. A vertical multiple stage oven as claimed in claim 3 wherein the vertical transport system includes a first plurality of support elements and transport elements positioned in the first plurality of ovens and a second plurality of support elements and transport elements positioned in the second plurality of ovens.

14. A vertical multiple stage oven as claimed in claim 13 wherein a motor assembly includes a first motor for rotating the plurality of support elements, a second motor for rotating the plurality of transport elements, and a third motor for reciprocating the plurality of transport elements in each of the first plurality of ovens and the second plurality of ovens.

15. A vertical multiple stage oven comprising:

a first plurality of ovens in a vertical arrangement;

a second plurality of ovens in a vertical arrangement positioned adjacent the first plurality of ovens;

an access port to the first plurality of ovens;

an exit port from the second plurality of ovens;

a coupling port coupling the first plurality of ovens to the second plurality of ovens;

a continuous pathway through the first plurality of ovens and through the second plurality of ovens from the access port, through the coupling port to the exit port; and each of the first plurality of ovens and the second plurality of ovens includes a tray input opening and a tray output opening delineating the pathway, and further including a plurality of trays movable in a plurality of steps along the pathway, with selected steps positioning a tray in at least one of the tray input openings and tray output openings sealing a corresponding one of the first and second plurality of ovens from an adjacent one of the first and second plurality of ovens.

16. A vertical multiple stage oven as claimed in claim 15 wherein each of the tray input openings and the tray output openings have an approximately similar area, and each tray of the plurality of trays has an area approximately similar to the area of the tray input openings and the tray output openings.

17. A vertical multiple stage oven as claimed in claim 15 further including a vertical transport system adapted to receive the plurality of trays and move each tray of the plurality of trays in steps along the continuous pathway from the access port to the exit port.

18. A vertical multiple stage oven as claimed in claim 17 further including a lateral transport system carrying each tray of the plurality of trays along the continuous pathway through the coupling port from the first plurality of ovens to the second plurality of ovens.

19. A vertical multiple stage oven as claimed in claim 18 wherein the lateral transport system receives the trays from a last step in the first plurality of ovens and carries the trays to a first step in the second plurality of ovens.

20. A vertical multiple stage oven as claimed in claim 19 wherein the vertical transport system is constructed to lift each tray of the plurality of trays, in a last step in the first plurality of ovens, into engagement with the lateral transport system and to lift each tray of the plurality of trays, in a first step in the second plurality of ovens out of engagement with the lateral transport system.

21. A vertical multiple stage oven as claimed in claim 20 wherein the lateral transport system includes a plurality of vertically extending hooks designed to engage a plurality of projections on each tray of the plurality of trays, with the hooks being positioned to engage the projections on each tray during an upward movement of the tray by the vertical transport system and disengage the tray from the tray engaging members during a downward movement of the tray by the vertical transport system.

22. A vertical multiple stage oven as claimed in claim 21 wherein the lateral transport system further includes the plurality of vertically extending hooks extending from a carriage laterally moveable between the first plurality of ovens and the second plurality of ovens through the coupling port.

23. A vertical multiple stage oven comprising:

a first plurality of ovens in a vertical arrangement and a second plurality of ovens in a vertical arrangement positioned adjacent the first plurality of ovens;

an access port to the first plurality of ovens;

an exit port from the second plurality of ovens;

a coupling port coupling the first plurality of ovens to the second plurality of ovens;

a continuous pathway through the first plurality of ovens and through the second plurality of ovens from the access port, through the coupling port to the exit port;

the first plurality of ovens and the second plurality of ovens being included within a common housing, with the access port and the exit port defined by the common housing, and each of the first plurality of ovens and the second plurality of ovens including a tray input opening and a tray output opening delineating the continuous pathway; and a vertical transport system adapted to receive a plurality of trays and move each tray of the plurality of trays in steps along the continuous pathway from the access port to the exit port, the steps along the continuous pathway including steps within each oven and steps in the tray input openings and tray output openings of each oven, the vertical transport system includes a plurality of elongated support elements each mounted for rotation about a longitudinal axis, and a plurality of elongated transport elements each mounted for rotation about a longitudinal axis and for reciprocation along the longitudinal axis, each support element and transport element having a plurality of tray engaging members attached thereto.

24. A vertical multiple stage oven as claimed in claim 23 wherein the vertical transport system includes a first plurality of support elements and transport elements positioned in the first plurality of ovens and a second plurality of support elements and transport elements positioned in the second plurality of ovens.

25. A vertical multiple stage oven as claimed in claim 24 wherein the first plurality of support elements and transport elements and the second plurality of support elements and transport elements are actuated by a motor assembly coupled to one end thereof.

26. A vertical multiple stage oven as claimed in claim 25 wherein the motor assembly includes a first motor for rotating the plurality of support elements, a second motor for rotating the plurality of transport elements, and a third motor for reciprocating the plurality of transport elements in each of the first plurality of ovens and the second plurality of ovens.

27. A vertical multiple stage oven as claimed in claim 26 further including horizontal walls between vertically adjacent ovens of the plurality of ovens, the horizontal walls defining the tray input opening and tray output opening of adjacent ovens.

28. A vertical multiple stage oven as claimed in claim 27 wherein the horizontal walls each include bearings which receive and seal the plurality of support elements and transport elements within the tray input openings and tray output openings, an end of each of the plurality of support elements and transport elements opposite the one end coupled to the motor assembly being free and the bearings stabilizing and permitting axial expansion of the plurality of support elements and transport elements.

29. A vertical multiple stage oven as claimed in claim 28 wherein the motor assembly includes apparatus for reciprocation of the plurality of transport elements, which is adjustable to compensate for the axial expansion of the plurality of support elements and transport elements.

30. A vertical multiple stage oven comprising:

a first plurality of ovens in a vertical arrangement and a second plurality of ovens in a vertical arrangement positioned adjacent the first plurality of ovens;

an access port to the first plurality of ovens, an exit port from the second plurality of ovens, and a coupling port coupling the first plurality of ovens to the second plurality of ovens;

a continuous pathway through the first plurality of ovens and through the second plurality of ovens from the access port, through the coupling port to the exit port;

a vertical transport system adapted to receive a plurality of trays and move each tray of the plurality of trays in steps along the continuous pathway from the access port to the exit port, the vertical transport system including a plurality of elongated support elements each mounted for rotation about a longitudinal axis, and a plurality of elongated transport elements each mounted for rotation about a longitudinal axis and for reciprocation along the longitudinal axis, each support element and transport element having a plurality of tray engaging members attached thereto;

the plurality of support elements and the plurality of transport elements being actuated by a motor assembly coupled to one end of each support element and transport element;

horizontal walls positioned between vertically adjacent ovens of the first and second plurality of ovens, the horizontal walls defining a tray input opening and a tray output opening of adjacent ovens; and the horizontal walls each including bearings which receive, and seal the plurality of support elements and transport elements within the tray input openings and tray output openings, an end of each of the plurality of support elements and transport elements opposite the one end coupled to the motor assembly being free and the bearings stabilizing and permitting axial expansion of the plurality of support elements and transport elements.

31. A vertical multiple stage oven as claimed in claim 30 wherein the motor assembly further includes an adjustment for adjusting an amount of reciprocation of the transport elements in response to axial expansion of the plurality of transport elements.

32. A vertical multiple stage oven as claimed in claim 30 further including a lateral transport system carrying each tray of the plurality of trays along the continuous pathway through the coupling port from the first plurality of ovens to the second plurality of ovens.

33. A vertical multiple stage oven as claimed in claim 32 wherein the lateral transport system receives the trays from a last step in the first plurality of ovens and carries the trays to a first step in the second plurality of ovens.

34. A vertical multiple stage oven as claimed in claim 33 wherein the vertical transport system is constructed to lift each tray of the plurality of trays, in a last step in the first plurality of ovens, into engagement with the lateral transport system and to lift each tray of the plurality of trays, in a first step in the second plurality of ovens out of engagement with the lateral transport system.

35. A vertical multiple stage oven as claimed in claim 34 wherein the lateral transport system includes a plurality of vertically extending hooks designed to engage a plurality of projections on each tray of the plurality of trays, with the hooks being positioned to engage the projections on each tray during an upward movement of the tray by the vertical transport system and disengage the tray from the tray engaging members during a downward movement of the tray by the vertical transport system.

36. A vertical multiple stage oven as claimed in claim 35 wherein the lateral transport system further includes the plurality of vertically extending hooks extending from a carriage laterally moveable between the first plurality of ovens and the second plurality of ovens through the coupling port.

37. A vertical oven comprising:

a vertical oven having a bottom and a top;

a vertical transport system carried by the oven and including:

a plurality of elongated support elements each mounted for rotation about a longitudinal axis, and a plurality of elongated transport elements each mounted for rotation about a longitudinal axis and for reciprocation along the longitudinal axis, each support element and transport element having a plurality of tray engaging members attached thereto and an end extending downwardly through the bottom of the oven;

a motor assembly coupled to the end of each support element and transport element for rotation of the support elements and rotation and reciprocation of the transport elements;

whereby all engaged moving parts are mounted outside of the oven.

38. A vertical oven as claimed in claim 37 wherein the plurality of support elements and transport elements include vertically extending rods, and the plurality of engagement members include pins radially extending from the rods.

39. A vertical oven as claimed in claim 37 wherein the motor assembly includes a first motor for rotating the plurality of support elements, a second motor for rotating the plurality of transport elements, and a third motor for reciprocating the plurality of transport elements.

40. A vertical oven as claimed in claim 37 wherein an end of each of the plurality of support elements and transport elements opposite the end coupled to the motor assembly are free permitting axial expansion of the plurality of support elements and transport elements.

41. A vertical oven as claimed in claim 40 wherein the motor assembly includes apparatus for reciprocation of the plurality of transport elements, which is adjustable to compensate for the axial expansion of the plurality of support elements and transport elements.

42. A method of heating components in a plurality of stages comprising the steps of:

providing a vertical multiple stage oven including a first plurality of ovens in a vertical arrangement, a second plurality of ovens in a vertical arrangement positioned adjacent the first plurality of ovens, and a continuous pathway defined from an access port through the first plurality of ovens, through a coupling port to the second plurality of ovens, and through an exit port from the second plurality of ovens, each of the first plurality of ovens and the second plurality of ovens includes a tray input opening and a tray output opening delineating the pathway with each of the tray input openings and tray output openings having an approximately similar area;

positioning the components on trays, each tray having an area approximately similar to the area of the tray input openings and tray output openings; and moving each of the trays in steps along the continuous pathway from the access port to the exit port, at least one of the steps positioning one of the plurality of trays in one of the tray input openings and tray output openings so as to seal corresponding vertically adjacent ovens in one of the first plurality of ovens and the second plurality of ovens from each other.

43. A method of heating components in a plurality of stages as claimed in claim 42 wherein the step of moving each of the trays in steps along the continuous pathway includes:

providing a vertical transport system adapted to receive the plurality of trays and move each tray of the plurality of trays in steps along the continuous pathway from the access port to the exit port, the vertical transport system including a plurality of elongated support elements each mounted for rotation about a longitudinal axis and a plurality of elongated transport elements each mounted for rotation about a longitudinal axis and for reciprocation along the longitudinal axis, and actuated by a motor assembly coupled to one end of each support element and transport element with an end of each of the plurality of support elements and transport elements opposite the one end coupled to the motor assembly being free to permit axial expansion of the plurality of support elements and transport elements; and adjusting the amount of reciprocation of the elongated transport elements along the longitudinal axis in response to axial expansion.

44. A method of heating components in a plurality of stages as claimed in claim 43 wherein the step of moving each of the trays in steps along the continuous pathway further includes providing a lateral transfer system and the lateral transfer system carrying each tray of the plurality of trays along the continuous pathway through the coupling port from the first plurality of ovens to the second plurality of ovens.

45. A method of heating components in a plurality of stages as claimed in claim 44 wherein the step of the lateral transfer system carrying each tray includes the vertical transport system lifting each tray of the plurality of trays, in a last step in the first plurality of ovens, into engagement with the lateral transport system and lifting each tray of the plurality of trays, in a first step in the second plurality of ovens out of engagement with the lateral transport system.

46. A method of heating components in a plurality of stages as claimed in claim 45 wherein the step of providing the lateral transport system includes:

providing a plurality of vertically extending hooks designed to engage a plurality of projections on each tray of the plurality of trays; and positioning the hooks to engage the projections on each tray during the upward movement of the tray by the vertical transport system and disengage the tray from the tray engaging members during a downward movement of the tray by the vertical transport system.

47. A method of heating components in a plurality of stages as claimed in claim 46 wherein the step of providing the lateral transport system further includes the plurality of vertically extending hooks extending from a carriage laterally moveable between the first plurality of ovens and the second plurality of ovens through the coupling port.

* * * * *